US007020970B1

(12) United States Patent
Welch

(10) Patent No.: US 7,020,970 B1
(45) Date of Patent: Apr. 4, 2006

(54) SAW GUARD SYSTEM

(76) Inventor: James Welch, P.O. Box 881471, Steamboat Springs, CO (US) 80488

( * ) Notice: Subject to any disclaimer, the term of this patent is extended or adjusted under 35 U.S.C. 154(b) by 0 days.

(21) Appl. No.: 10/278,456

(22) Filed: Oct. 23, 2002

Related U.S. Application Data

(60) Provisional application No. 60/345,118, filed on Oct. 23, 2001.

(51) Int. Cl.
*B27G 19/04* (2006.01)

(52) U.S. Cl. ..... 30/391; 83/397; 83/478; 74/612

(58) Field of Classification Search ..... 30/391, 30/390, 388, 166, 276, 286, 382; 83/478, 83/471.2, 490, 497, 546, 522.12, 522.11; 74/608, 609, 612, 613
See application file for complete search history.

(56) References Cited

U.S. PATENT DOCUMENTS

| | | | | |
|---|---|---|---|---|
| 2,993,518 | A * | 7/1961 | Bork | 30/391 |
| 3,721,141 | A * | 3/1973 | Frostad | 83/478 |
| 3,730,239 | A * | 5/1973 | Kaman et al. | 30/391 |
| 3,805,639 | A * | 4/1974 | Peter | 74/616 |
| 4,399,803 | A * | 8/1983 | Bertini | 124/1 |
| 4,570,872 | A * | 2/1986 | Tsujimura et al. | 242/390.8 |
| 4,674,379 | A * | 6/1987 | Harris | 83/419 |
| 4,693,008 | A * | 9/1987 | Velie | 30/390 |
| 5,129,300 | A * | 7/1992 | Kawakami | 83/471.2 |
| 5,184,534 | A * | 2/1993 | Lee | 83/397 |
| 5,531,147 | A | 7/1996 | Serban | |
| 5,579,584 | A | 12/1996 | Hoffman | |
| 5,699,705 | A | 12/1997 | Sibbet | |
| 5,782,001 | A | 7/1998 | Gray | |
| 5,850,697 | A | 12/1998 | Welch | |
| 6,014,813 | A | 1/2000 | Merino | |
| 6,119,569 | A * | 9/2000 | Benedict et al. | 83/478 |
| 6,182,548 | B1 * | 2/2001 | Meredith et al. | 83/397 |
| 6,237,230 | B1 * | 5/2001 | Campbell et al. | 30/390 |
| 6,272,960 | B1 * | 8/2001 | Dibbern et al. | 83/471.3 |
| 6,279,442 | B1 * | 8/2001 | Chang | 83/397 |
| 6,405,624 | B1 * | 6/2002 | Sutton | 83/102.1 |
| 6,415,699 | B1 * | 7/2002 | Bettacchini et al. | 83/397 |
| 6,427,570 | B1 * | 8/2002 | Miller et al. | 83/100 |

* cited by examiner

*Primary Examiner*—Boyer Ashley
*Assistant Examiner*—Ghassem Alie

(57) ABSTRACT

A saw guard system for enhancing the safety of use of powered hand saws by eliminating the need to hold the blade guard in a static position during the cutting operation. The saw guard system includes a circular saw with a housing, a motor positioned within the housing, a shaft extending from the motor through a wall of the housing, a blade operationally coupled to the shaft, and an upper blade guard for covering a perimeter edge of the blade above the shaft; a lower guard member pivotally coupled to the housing, a guard member motor coupled to the housing and the lower guard member for moving the lower guard member from the deployed position to the stored position; the guard member motor is operable separately from the motor of the circular saw; and a gear assembly operationally coupling the guard member motor to the lower guard member.

13 Claims, 3 Drawing Sheets

SAW GUARD SYSTEM

CROSS REFERENCE TO RELATED APPLICATION

This application claims the benefit of U.S. Provisional Application No. 60/345,118, filed Oct. 23, 2001.

BACKGROUND OF THE INVENTION

1. Field of the Invention

The present invention relates to powered hand saws with movable blade guards and more particularly pertains to a new saw guard system for enhancing the safety of use of powered hand saws by eliminating the need to hold the blade guard in a static position during the cutting operation.

2. Description of the Prior Art

The use of powered hand saws with movable blade guards is known in the prior art. U.S. Pat. No. 6,014,813 describes a assembly for automatically raising a lower saw guard. However the disclosed system uses a plurality of teeth on an interior surface of the lower guard allowing debris to be caught between the saw blade and the lower guard increasing a chance of injury or binding of the saw. Another type of powered hand saws with movable blade guards is U.S. Pat. No. 5,699,705 which is activated with the same trigger mechanism that engages the saw increasing a likelihood of accidental starts of the saw when attempting to raise the lower guard.

While these devices fulfill their respective, particular objectives and requirements, the need remains for a system that increases the safety of operation with a separate activation for the lower blade guard, and a drive assembly which is not prone to catch debris.

SUMMARY OF THE INVENTION

The present invention meets the needs presented above by utilizing a drive gear system away from the blade guard and using a separate activation switch to facilitate controlled activation of the blade guard separate from the saw motor.

An object of the present invention is to provide a new saw guard system that facilitates two hand operation of the saw when cutting various thickness and types of material.

Another object of the present invention is to provide a new saw guard system that can position the lower blade guard in a stored position prior to engaging the motor of the saw.

To this end, the present invention generally comprises a circular saw with a housing, a motor positioned within the housing, a shaft extending from the motor through a wall of the housing, a blade operationally coupled to the shaft, and an upper blade guard for covering a perimeter edge of the blade above the shaft; a lower guard member pivotally coupled to the housing, a guard member motor coupled to the housing and the lower guard member for moving the lower guard member from the deployed position to the stored position; the guard member motor is operable separately from the motor of the circular saw; and a gear assembly operationally coupling the guard member motor to the lower guard member.

The inventive device includes a guard lifting motor with a gearbox mounted on the saw, a mounting bracket, a lower saw guard gear, a spring, a limiting switch electrically connected to the motor, control circuitry, a safety switch, a safety light and an activating switch.

A switch is located conveniently on the saw's handle activates the guard lifting motor through the control circuitry. The motor's shaft rotation is translated thru the gearbox, final drive gear, idler gear, and lower saw guard gear, and in turn raises the lower saw guard. When the lower saw guard has retracted nearly fully, a limiting switch and control circuitry limits the rotational power to the motor to maintain the retracted position of the lower saw guard against the return spring. As long as the activating switch remains closed, the lower saw guard remains in the fully open position. If the activating switch is released the power to the guard lifting motor is shut off and the spring connected to the saw housing closes the lower saw guard. In order to use the guard lifting motor, a remote safety switch must be closed. This button resets to the open position if the power to the saw is interrupted. Safety switch can be manually opened or closed.

Multiple arrangements of the blade guard lifting system are possible. The blade guard lifting system can function without the use of a safety switch and the safety light. In this arrangement the guard lifting motor has power continuously as long as the saw itself has power. Closing the activating switch is all that is required to retract the lower saw guard. Variations in the motor and gearing arrangement (size, quantity, type and location) are within the scope of this claim. A logical alternative would be to equip the output shaft of the guard lifting motor with a pinion gear. This gear could be moved into position by a spring-loaded solenoid mechanism. When the activating switch is closed the solenoid would engage the pinion gear to the lower saw guard gear. The guard lifting motor would retract the lower saw guard until the limit switch is reached. When the activating switch is released the power to the solenoid is shut off and the pinion gear is disengaged. The lower saw guard then operates in the conventional manner.

This invention allows a user to keep both hands on the saw at all times. This is achieved by closing the safety switch and then closing the activating switch that retracts the lower saw guard automatically thereby preventing any interference between the lower saw guard and the material being cut. Alternatively this device allows for single hand operation. This affords the operator the security of another hand to stabilize either the object being cut and/or the operator himself.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
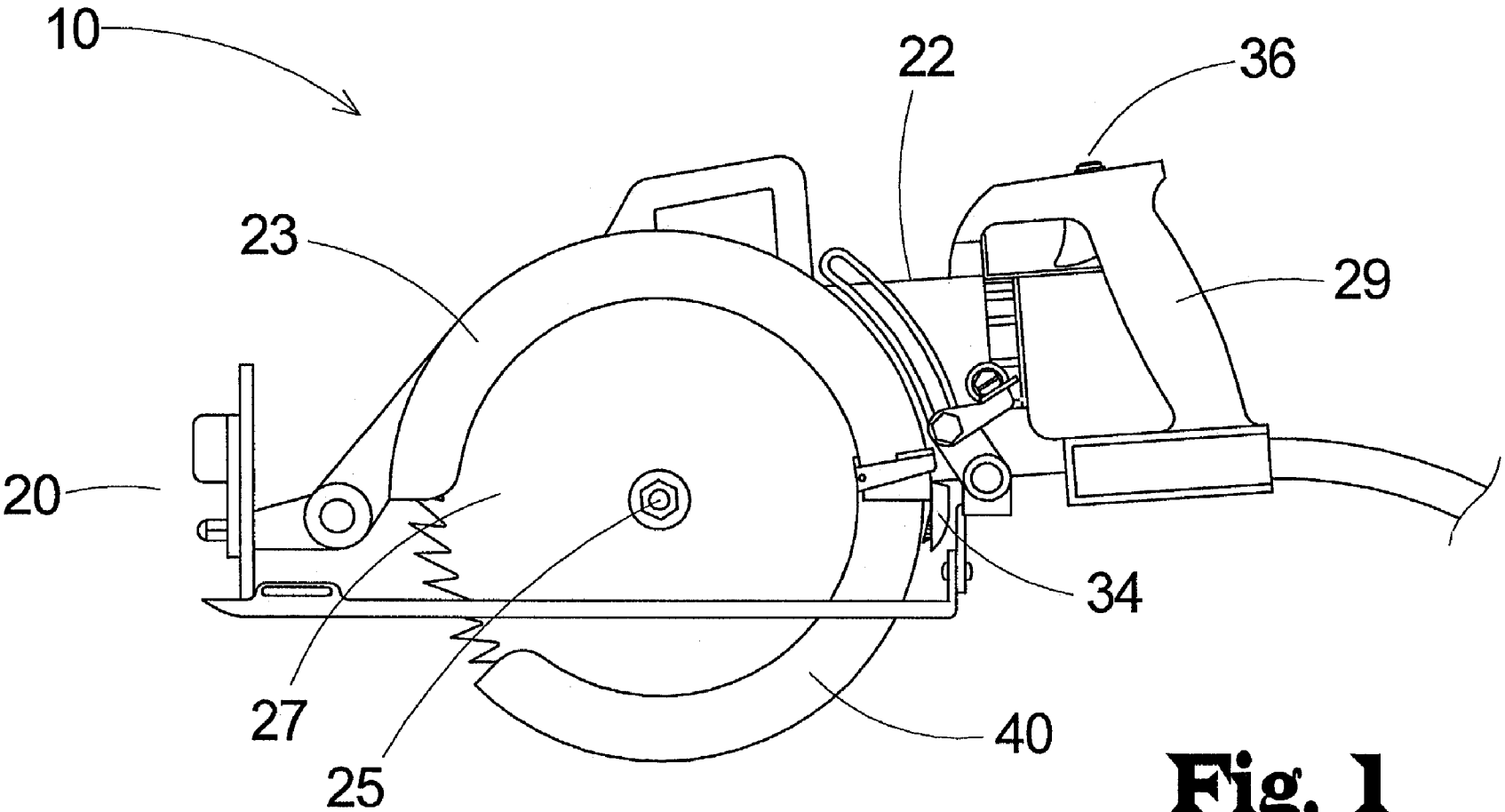
FIG. 1 is a schematic front view of a new saw guard system according to the present invention.
Figure 2:
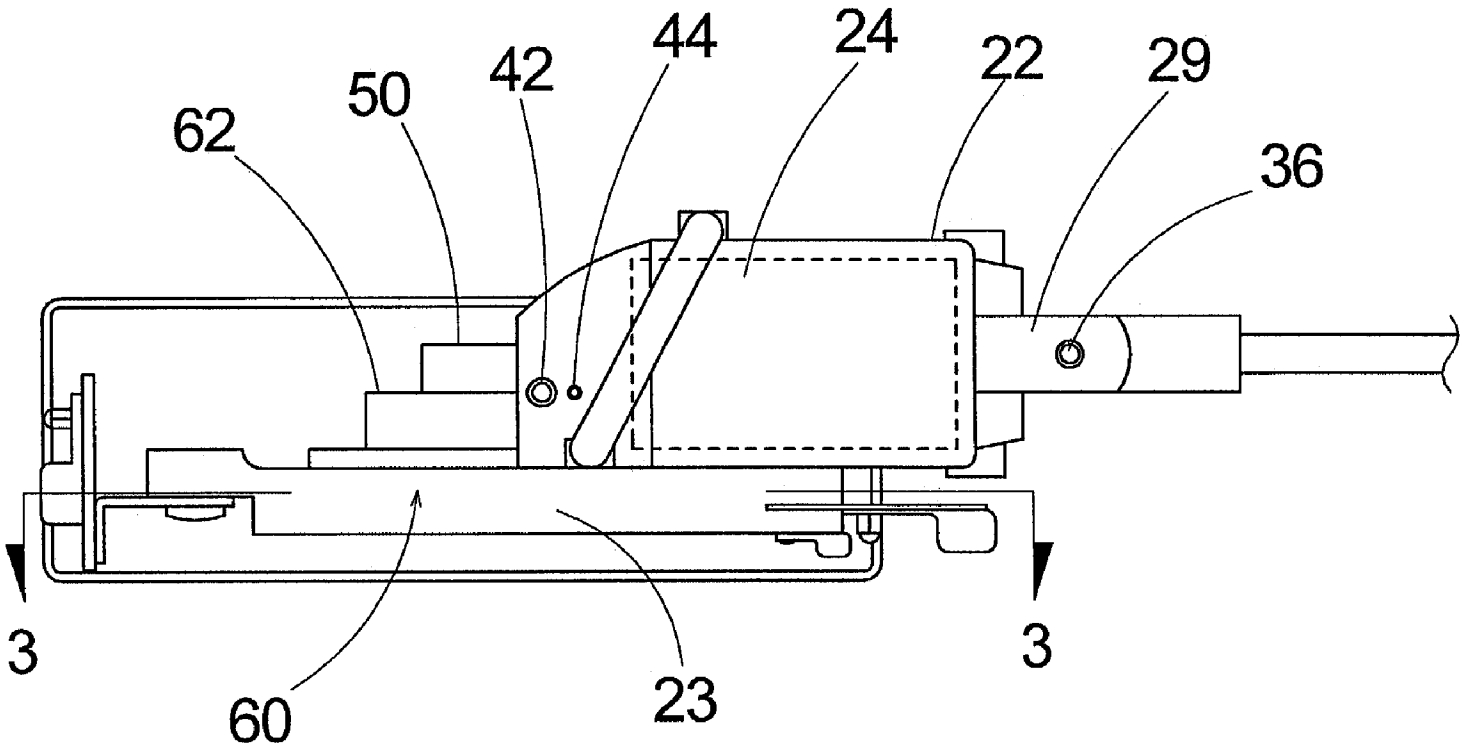
FIG. 2 is a schematic top view of the present invention.
Figure 3:
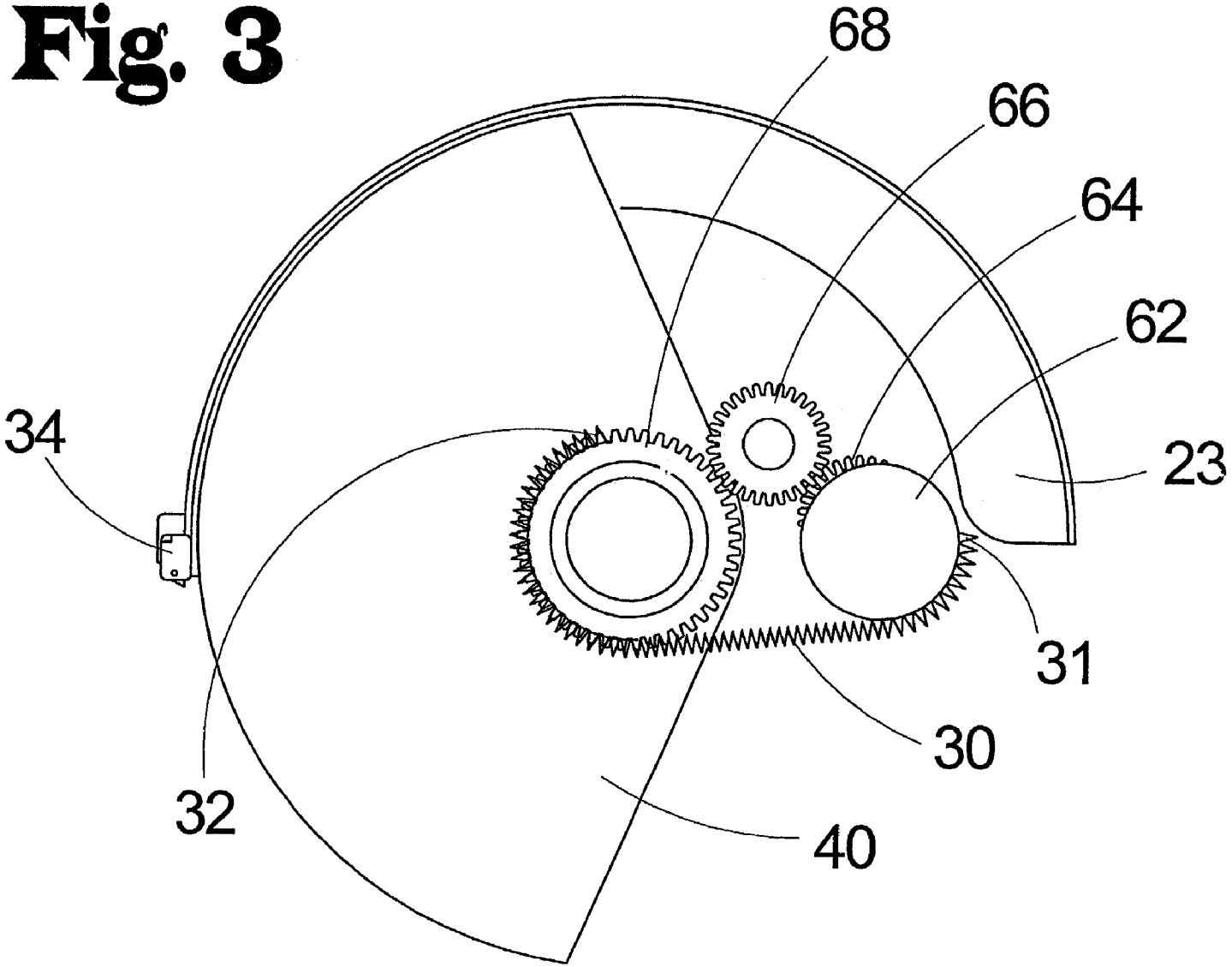
FIG. 3 is a schematic detail view of the lower guard member and gear assembly of the present invention.

With reference now to the drawings, and in particular to FIGS. 1 through 3 thereof, a new saw guard system embodying the principles and concepts of the present invention and generally designated by the reference numeral 10 will be described.

As best illustrated in FIGS. 1 through 3, the saw guard system 10 generally comprises a circular saw 20, a lower guard member 40, a guard member motor 50, and a gear assembly 60.

The circular saw 20 includes a housing 22 and a motor 24 positioned within the housing 22. The motor 24 includes a shaft 25, which extends through a wall of the housing 22. The circular saw 20 also includes a blade 27, which is operationally coupled to the shaft 25. The housing 22 includes an upper blade guard 23 for covering a perimeter edge of the blade 27 above the shaft 25.

The lower guard member 40 is preferably pivotally coupled to the housing 22. The lower guard member 40 has a deployed position and a stored position. The deployed position is defined by the lower guard member 40 covering at least a 75 degree arc of the perimeter edge of the blade 27 below the shaft 25. The stored position is defined by a leading edge of the lower guard member 40 being adjacent to a leading edge of the upper blade guard 23.

The guard member motor 50 may be coupled to the housing 22 and the lower guard member 40. Alternately, the guard member motor 50 may also be positioned within the housing 22. The guard member motor 50 is for moving the lower guard member 40 from the deployed position to the stored position. The guard member motor 50 is operable separately from the motor 24 of the circular saw 20.

The gear assembly 60 operationally couples the guard member motor 50 to the lower guard member 40.

In an embodiment the gear assembly 60 further comprises a gear box 62, a final drive gear 64, an idler gear 66 and a lower saw guard gear 68. The gear box 62 is operationally coupled to the guard member motor 50. The gear box 62 converts rotational speed and torque from the guard member motor 50. The final drive gear 64 is preferably rotatably coupled to the housing 22. The final drive gear 64 engages the gear box 62. The idler gear 66 is also preferably rotatably coupled to the housing 22. The idler gear 66 engages the final drive gear 64. The lower saw guard gear 68 is preferably coupled to the lower guard member 40. Preferably, the guard member motor 50 engages the gear box 62. The gear box 62 engages and rotates the final drive gear 64 which engages and rotates the idler gear 66, which in-turn engages and rotates the lower saw guard gear 68. Thus, the lower guard member 40 is moved between the deployed position and the stored position.

A spring member 30 includes a first end 31 and a second end 32. The first end 31 is coupled to the housing 22. The second end 32 is coupled to the lower guard member 40. The spring member 30 is positioned in a manner which allows the spring member 30 to oppose the action of the guard member motor 50 and the gear assembly 60. The spring member 30 biases the lower guard member 40 towards the deployed position. Preferably, the spring member 30 has a tension force sufficient to overcome the guard member motor 50 and the gear assembly 60 when the guard member motor 50 is not powered.

The housing 22 may further comprise a handle 29 designed for being grasped by a human hand. The handle 29 is for guiding the circular saw 20 during operation.

A limit switch 34 is preferably operationally coupled to the housing 22. The limit switch 34 is activated by the lower guard member 40 moving to the stored position. The limit switch 34 is also operationally coupled to the guard member motor 50. The limit switch 34 reduces power to the guard member motor 50 so that the lower guard member 40 is held in the stored position against the force of the spring member 30 but does not continue to rotate farther from the deployed position.

The limit switch 34 may be a motion switch, optical sensor, magnetic sensor, electro-mechanical switch, or any other appropriate device.

In a preferred embodiment, an activation switch 36 for activating the guard member motor 50 is coupled to the handle 29 for operation by the user.

A further preferred embodiment includes a safety switch 42. The safety switch 42 is normally open. The safety switch 42 is operationally coupled to the guard member motor 50. The safety switch 42 inhibits operation of the guard member motor 50 when the safety switch 42 is in the open position. The safety switch 42 allows operation of the guard member motor 50 when the safety switch 40 is in a closed position. The safety switch 40 is coupled to the housing 22.

In still a further embodiment, a safety lamp 44 is operationally coupled to the guard member motor 50. The safety lamp 44 is illuminated when power is applied to the guard member motor 50.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A circular saw with automatic blade guard lifting system comprising:

a circular saw having a housing, said circular saw having a motor positioned within said housing, said motor having a shaft extending through a wall of said housing, said circular saw having a blade operationally coupled to said shaft, said housing having an upper blade guard for covering a perimeter edge of said blade above said shaft;

a lower guard member pivotally coupled to said housing, said lower guard member having a deployed position and a stored position, said deployed position being defined by said lower guard member covering at least a 75 degree arc of said perimeter edge of said blade below said shaft, said stored position being defined by a leading edge of said lower guard member being adjacent to a leading edge of said upper blade guard, a guard member motor coupled to said housing and said lower guard member, said guard member motor being for moving said lower guard member from said deployed position to said stored position, said guard member motor being operable separately from said motor of said circular saw;

a gear assembly operationally coupling said guard member motor to said lower guard member;

a spring member having a first end and a second end, said first end being operationally couplable to said housing, said second end being coupled to said lower guard member, said spring member being positioned such that said spring member opposes action of said guard member motor and said gear assembly, said spring member biasing said lower guard member towards said deployed position; and wherein said spring member having a tension force sufficient to overcome said guard member motor and said gear assembly when said guard member motor is not powered.

2. The system of claim 1, wherein said gear assembly further comprises:

a gear box operationally coupled to said guard member motor, said gear box converting rotational speed and torque from said guard member motor;

a final drive gear rotatably coupled to said housing, said final drive gear engaging said gear box;

an idler gear rotatably coupled to said housing, said idler gear engaging said final drive gear;

a lower saw guard gear coupled to said lower guard member;

wherein said guard member motor engages said gear box, said gear box engages and rotates said final drive gear which engages and rotates said idler gear, which in-turn engages and rotates said lower saw guard gear whereby said lower guard member is moved between said deployed position and said stored position.

3. The system of claim 1, wherein said housing further comprises a handle adapted for being grasped by a human hand, said handle being for guiding said circular saw during operation.

4. The system of claim 1, further comprising:

wherein said gear assembly further comprises:

a gear box operationally coupled to said guard member motor, said gear box converting rotational speed and torque from said guard member motor;

a final drive gear rotatably coupled to said housing, said final drive gear engaging said gear box;

an idler gear rotatably coupled to said housing, said idler gear engaging said final drive gear;

a lower saw guard gear coupled to said lower guard member;

wherein said guard member motor engages said gear box, said gear box engages and rotates said final drive gear which engages and rotates said idler gear, which in-turn engages and rotates said lower saw guard gear whereby said lower guard member is moved between said deployed position and said stored position;

said housing farther comprises a handle adapted for being grasped by a human hand, said handle being for guiding said circular saw during operation.

5. The system of claim 4, further comprising a limit switch operationally coupled to said housing, said limit switch being activated by said lower guard member moving to said stored position, said limit switch being operationally coupled to said guard member motor, said limit switch reducing power to said guard member motor to hold said lower guard member in said stored position against the force of said spring member but not continuing to rotate said lower guard member farther from said deployed position.

6. The system of claim 4, further comprising an activation switch for activating said guard member motor, said activation switch being coupled to said handle for operation by the user.

7. The system of claim 6, further comprising a safety switch, said safety switch being normally open, said safety switch being operationally coupled to said guard member motor, said safety switch inhibiting operation of said guard member motor when said safety switch is in said open position, said safety switch allowing operation of said guard member motor when said safety switch being in a closed position, said safety switch being coupled to said housing.

8. The system of claim 4, further comprising a safety lamp, said safety lamp being operationally coupled to said guard member motor, said safety lamp being illuminated when power is applied to said guard member motor.

9. The system of claim 4, further comprising:

a limit switch operationally coupled to said housing, said limit switch being activated by said lower guard member moving to said stored position, said limit switch being operationally coupled to said guard member motor, said limit switch reducing power to said guard member motor to hold said lower guard member in said stored position against the force of said spring member but not continuing to rotate said lower guard member farther from said deployed position;

an activation switch for activating said guard member motor, said activation switch being coupled to said handle for operation by the user;

a safety switch, said safety switch being normally open, said safety switch being operationally coupled to said guard member motor, said safety switch inhibiting operation of said guard member motor when said safety switch is in said open position, said safety switch allowing operation of said guard member motor when said safety switch being in a closed position, said safety switch being coupled to said housing; and a safety lamp, said safety lamp being operationally coupled to said guard member motor, said safety lamp being illuminated when power is applied to said guard member motor.

10. An automatic blade guard lifting system for attachment on a conventional circular saw, the circular saw having a housing, the circular saw having a motor positioned within the housing, the motor having a shaft extending through a wall of the housing, the circular saw having a blade operationally coupled to the shaft, the housing having an upper blade guard for covering a perimeter edge of the blade above the shaft, the system comprising:

a lower guard member pivotally couplable to the housing, said lower guard member having a deployed position and a stored position, said deployed position being defined by said lower guard member covering at least a 75 degree arc of said perimeter edge of the blade below the shaft, said stored position being defined by a leading edge of said lower guard member being adjacent to a leading edge of the upper blade guard, a guard member motor couplable to the housing and said lower guard member, said guard member motor being for moving said lower guard member from said deployed position to said stored position, said guard member motor being operable separately from the motor of the circular saw;

a gear assembly operationally coupling said guard member motor to said lower guard member;

a spring member having a first end and a second end, said first end being operationally couplable to the housing, said second end being coupled to said lower guard member, said spring member being positioned such that said spring member opposes action of said guard member motor and said gear assembly, said spring member biasing said lower guard member towards said deployed position; and said spring member having a tension force sufficient to overcome said guard member motor and said gear assembly when said guard member motor is not powered.

11. The system of claim 10, further comprising:

wherein said gear assembly further comprises:

a gear box operationally coupled to said guard member motor, said gear box converting rotational speed and torque from said guard member motor;

a final drive gear rotatably coupled to said housing, said final drive gear engaging said gear box;

an idler gear rotatably coupled to said housing, said idler gear engaging said final drive gear;

a lower saw guard gear coupled to said lower guard member;

wherein said guard member motor engages said gear box, said gear box engages and rotates said final drive gear which engages and rotates said idler gear, which in-turn engages and rotates said lower saw guard gear whereby said lower guard member is moved between said deployed position and said stored position.

12. The system of claim 11, further comprising:

a limit switch operationally couplable to the housing, said limit switch being activated by said lower guard member moving to said stored position, said limit switch being operationally coupled to said guard member motor, said limit switch reducing power to said guard member motor to hold said lower guard member in said stored position against the force of said spring member but not continuing to rotate said lower guard member farther from said deployed position;

an activation switch for activating said guard member motor, said activation switch being coupled to a handle portion of the housing of the saw for operation by the user;

a safety switch, said safety switch being normally open, said safety switch being operationally coupled to said guard member motor, said safety switch inhibiting operation of said guard member motor when said safety switch is in said open position, said safety switch allowing operation of said guard member motor when said safety switch being in a closed position, said safety switch being couplable to the housing; and a safety lamp, said safety lamp being operationally coupled to said guard member motor, said safety lamp being illuminated when power is applied to said guard member motor.

13. The system of claim 12, wherein said limit switch being selected from the group of limit switches consisting of motion switch, optical sensor, magnetic sensor and electromechanical switch.

* * * * *